US008100394B2

(12) United States Patent
Rohe-Krebeck

(10) Patent No.: US 8,100,394 B2
(45) Date of Patent: Jan. 24, 2012

(54) METHOD AND DEVICE FOR AFFIXING A MARKING RIBBON TO A BOOK OR A BROCHURE

(75) Inventor: Ansgar Rohe-Krebeck, Steinfeld (DE)

(73) Assignee: Kolbus GmbH & Co. KG, Rahden (DE)

( * ) Notice: Subject to any disclaimer, the term of this patent is extended or adjusted under 35 U.S.C. 154(b) by 225 days.

(21) Appl. No.: 12/584,405

(22) Filed: Sep. 4, 2009

(65) Prior Publication Data

US 2010/0064497 A1 Mar. 18, 2010

(30) Foreign Application Priority Data

Sep. 17, 2008 (DE) ..... 10 2008 047 481

(51) Int. Cl.
*B42C 1/10* (2006.01)

(52) U.S. Cl. ..... 270/58.32; 270/58.31; 412/36

(58) Field of Classification Search ..... 270/52.17, 270/58.31, 58.32; 412/36
See application file for complete search history.

(56) References Cited

U.S. PATENT DOCUMENTS

| | | | | |
|---|---|---|---|---|
| 3,813,093 | A * | 5/1974 | Taupin | 270/58.32 |
| 4,872,797 | A * | 10/1989 | Schniter | 412/25 |
| 6,193,228 | B1 * | 2/2001 | Shimao et al. | 270/58.32 |
| 6,729,376 | B1 * | 5/2004 | Kakinuma et al. | 156/521 |

FOREIGN PATENT DOCUMENTS

| | | | |
|---|---|---|---|
| DE | 20 53 648 | A | 5/1972 |
| DE | 37 17 970 | C1 | 9/1988 |
| DE | 38 26 719 | A1 | 2/1990 |
| DE | 100 45 900 | A1 | 3/2002 |
| DE | 10 2006 003 346 | A1 | 8/2007 |

* cited by examiner

*Primary Examiner* — Patrick Mackey
(74) *Attorney, Agent, or Firm* — Alix, Yale & Ristas, LLP

(57) ABSTRACT

A marking ribbon (2) is affixed to a book block (3) in that a partial book block (10; 10.1 . . . 3) with at least one sheet (8.3) has the marking ribbon (2) is placed on the top sheet (8.3) before at least one other sheet (8.4) is deposited on the partial book block (10; 10.1 . . . 3) with the marking ribbon (2) placed thereon during the additional gathering. The gathered book block (12) with the marking ribbon (2) is subsequently bound and trimmed on three sides at the non-bound edges.

26 Claims, 3 Drawing Sheets

METHOD AND DEVICE FOR AFFIXING A MARKING RIBBON TO A BOOK OR A BROCHURE

BACKGROUND

The invention pertains to a method and a device for affixing a marking ribbon to a book or a brochure featuring a book block that is formed by gathering several sheets such as, e.g., folded sections and/or single sheets and thread-sewn and/or perfect-bound in the spine, as well as the marking ribbon fixed within the book block.

A marking ribbon that is solidly affixed to the book or the brochure in the form of a bookmark makes it possible to easily and quickly locate text passages.

In hardcover books, the marking ribbon is thus far inserted into the book block after the trimming of the book block on three sides and fixed on the book block spine with one end while the free end is drawn into the book block offset to the insertion point. Such a method is known, for example, from DE 20 53 648 A and used on self-contained marking ribbon inserting machines in the transport section between the three-knife trimmer and the book production line. In the book production line, the book block spine is subsequently lined with a lining paper that includes headbands affixed to its ends and ultimately cased in a case such that the marking ribbon emerges underneath the headband in the spine on the head side on the finished books. In brochures, the above-described method cannot be used because the book block is already cased in the cover in the perfect binding machine, i.e., prior to the trimming on three sides.

DE 100 45 900 A1 discloses a book with a marking ribbon, in which the marking ribbon is situated in a cavity of the spine, from which it can be pulled by the user, until its initial use. The marking ribbon is affixed by being placed on the book block spine—a step that can be carried out in the book production line together with the lining of the book block. Alternatively, the marking ribbon can be affixed prior to the trimming on three sides, e.g., in the perfect binding machine, such that at least Lay-Flat brochures with a hollow spine between the cover that is glued to the book block sides and the lined book block spine can be equipped with a marking ribbon fixed in the spine. In classic brochures without a hollow spine, this type of affixing the marking ribbon can only be realized if the marking ribbon is accommodated in a sleeve that is subsequently embedded in the brochure spine.

DE 10 2006 003 346 A1 discloses a book or a brochure with a marking ribbon fixed within the book block, wherein the fixing end of the marking ribbon is guided through a hole pierced into the joint of one of the folded sections forming the book block and fixed on this folded section. Until its initial use, the marking ribbon is situated on a certain page within the book block. When it is in use, the marking ribbon emerges from the head cut of the book block. The marking ribbon needs to be introduced into the corresponding folded section prior to the gathering by initially opening the folded section, piercing the hole in the joint near the edge at the head, guiding the marking ribbon through the hole with one end and subsequently fixing the marking ribbon on the folded section with this end.

The integration of these relatively complex production steps into a folding machine as proposed in DE 10 2006 003 346 A1 is complicated and limits the production capacity of the machine. With respect to the broadest possible availability of the marking ribbon introduction in the different production methods, one also needs to consider the diversity of folding devices that are used in dependence on the production type and the number of pages, e.g., knife folders, buckle folders or combination folders in sheet-processing machines or newspaper folders and nip-and-tuck folders in web-fed printing machines. In addition, the introduction of the marking ribbon with a separate machine requires additional operating personnel for the loading and unloading processes, occupies production space due to the intermediate storage of the folded sections and increases the processing time for orders. Another disadvantage of the method can be seen in that the marking ribbon cannot be affixed to an individual sheet.

SUMMARY

The present invention is based on the objective of providing a method for affixing a marking ribbon to a book or a brochure that can be universally utilized for different book and brochure production methods and still carried out in a cost-efficient fashion. Another objective is to provide a device with a simple construction for carrying out this method.

The solution is to affix the marking ribbon during the gathering of the book block. The marking ribbon is placed on the top sheet of a thus far gathered partial book block like a supplement. The loosely gathered book block with the marking ribbon positioned in the interior of thereof in a protected fashion is formed by adding additional sheets. The book block with the marking ribbon is subsequently fed to any type of binding machine and ultimately to the three-knife trimmer.

The placement of the marking ribbon can be realized in a particularly simple fashion because the corresponding sheet is freely accessible from above during the gathering process. Consequently, it is no longer required to open a folded section or a book block. Due to the integration into the gathering machine, the separate processing steps required so far are eliminated. The required operating personnel and the required production space are reduced and the processing time for the respective orders can be shortened. Furthermore, it is now possible to equip different book and brochure constructions with a marking ribbon because a book block is always gathered from a plurality of (folded) sheets in the gathering machine in all production methods and product variations. The marking ribbon can also be affixed to any type of sheet in accordance with the invention. The sheet, on which the marking ribbon is placed, may consist of an individual sheet or of a sheet that is folded in any suitable way in folding devices of web-fed printing machines or in different sheet folding machines.

The placement of the marking ribbon can be realized by means of an exchange station of the gathering machine such that any position of the marking ribbon within the book block can be defined. In addition, gathering machines that are realized modularly in this respect can also be retrofitted with this function such that the method can also be subsequently integrated into existing production lines.

BRIEF DESCRIPTION OF THE DRAWING

Aspects of the invention are described in greater detail below with reference to the drawing, wherein.

DETAILED DESCRIPTION

Figure 1A:
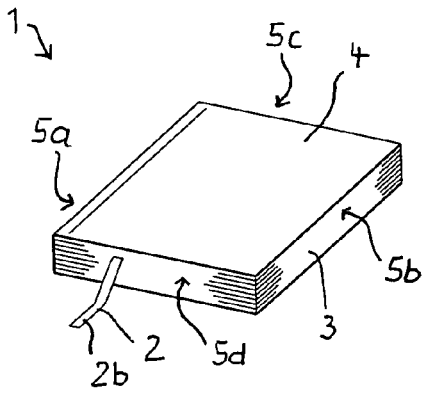
FIG. 1*a* shows a brochure 1 equipped with a marking ribbon 2.
Figure 1B:
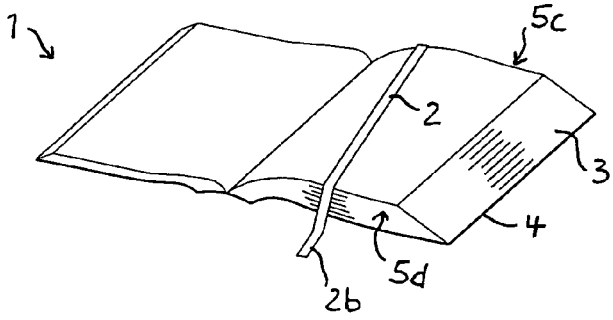
FIG. 1*b* shows the brochure 1 that is opened at a position identified by the marking ribbon.
Figure 2B:
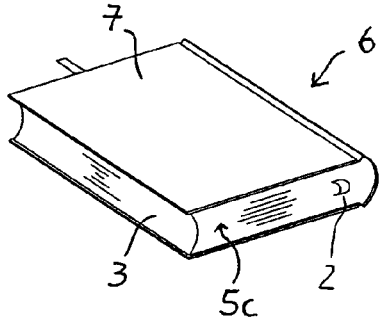
Figure 1C:
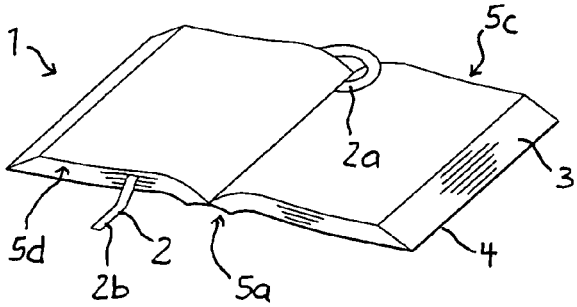
FIG. 1*c* shows the brochure 1 that is opened at the position, at which the marking ribbon is affixed in the book block.

The brochure 1 shown in FIGS. 1*a* to *c* is equipped with a marking ribbon 2 that is fixed within the book block 3 with a first end 2*a*. The brochure 1 features a cover 4 that is glued around the perfect-bound book block 3 in the spine 5*a* and lateral surfaces near the spine. The three cuts are referred to as front cut 5*b*, head cut 5*c* and foot cut 5*d*.

The marking ribbon 2 serves for identifying text portions by emerging from the foot cut 5*d* at the corresponding position with its second free end 2*b* in the closed position of the brochure 1 according to FIG. 1*a*. The second end 2*b* can be taken hold of in order to open the corresponding page. According to FIG. 1*b*, the marking ribbon 2 extends from the head cut 5*c* to the foot cut 5*d* on the corresponding page.

The first end 2*a* of the marking ribbon 2 serves as the fixing end and is fixed on any page of the book block 3, preferably a largely central page. In FIG. 1*c*, the brochure 1 is opened at the position, at which the marking ribbon 2 is fixed in the book block 3. In this case, the first end 2*a* is permanently glued to the respective page in the spine and near the spine and extends from there to the head cut 5*c*, where it emerges from the book block 3 in order to once again extend into the book block 3 at a different location so as to identify the respective page as described above.

Figure 2A:
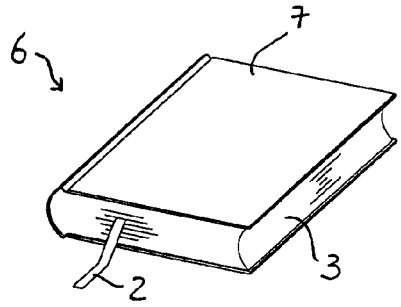
FIGS. 2 *a, b* show different perspective representations of a book 6 equipped with a marking ribbon 2.

FIGS. 2*a* and *b* show a (hardcover) book 6 with a book block 3 that is cased in a case 7, wherein the book 6 is equipped with an inventively affixed marking ribbon 2. The book block 3 may be thread-sewn and/or perfect-bound. In contrast to the classic method for affixing a marking ribbon to a (hardcover) book 6, in which the marking ribbon is fixed on the block spine and emerges underneath the head-band in the spine of the book block, the marking ribbon 2 emerges from the head cut 5*c* analogous to the brochure 1 in this case. However, the function remains unchanged.

Figure 3A:
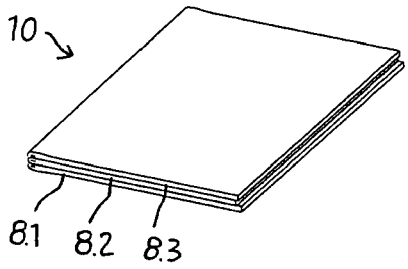
FIG. 3*a* shows a sheet stack that is gathered into a partial book block 10.
Figure 3B:
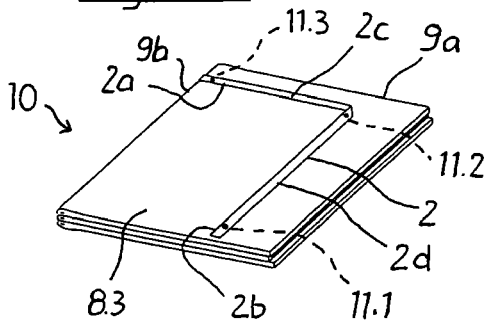
FIG. 3*b* shows the partial book block 10, on the top sheet of which a marking ribbon is placed.
Figure 3C:
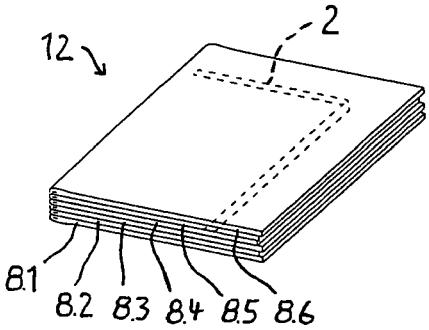
FIG. 3*c* shows a sheet stack that is completely gathered into a loose book block 12 and a marking ribbon lying thereon.
Figure 3D:
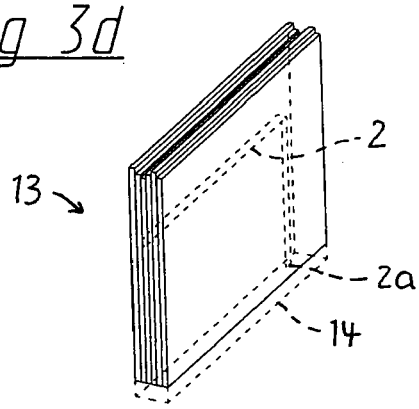
FIG. 3*d* shows a book block 13 that is processed on the spine.
Figure 3E:
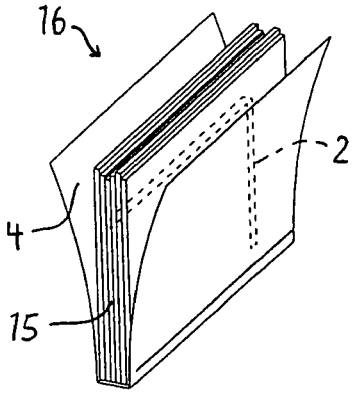
FIG. 3*e* shows a book block 15 that is bound in the spine and features a cover glued thereon.
Figure 3F:
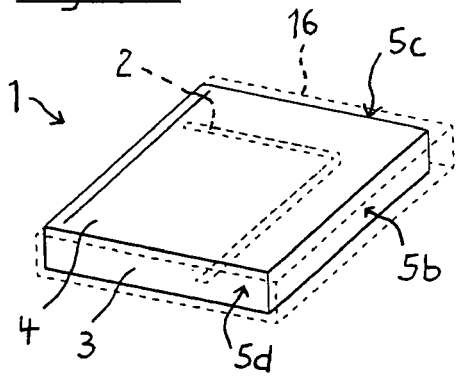
FIG. 3*f* shows the brochure 1 trimmed on three sides.
Figure 4:
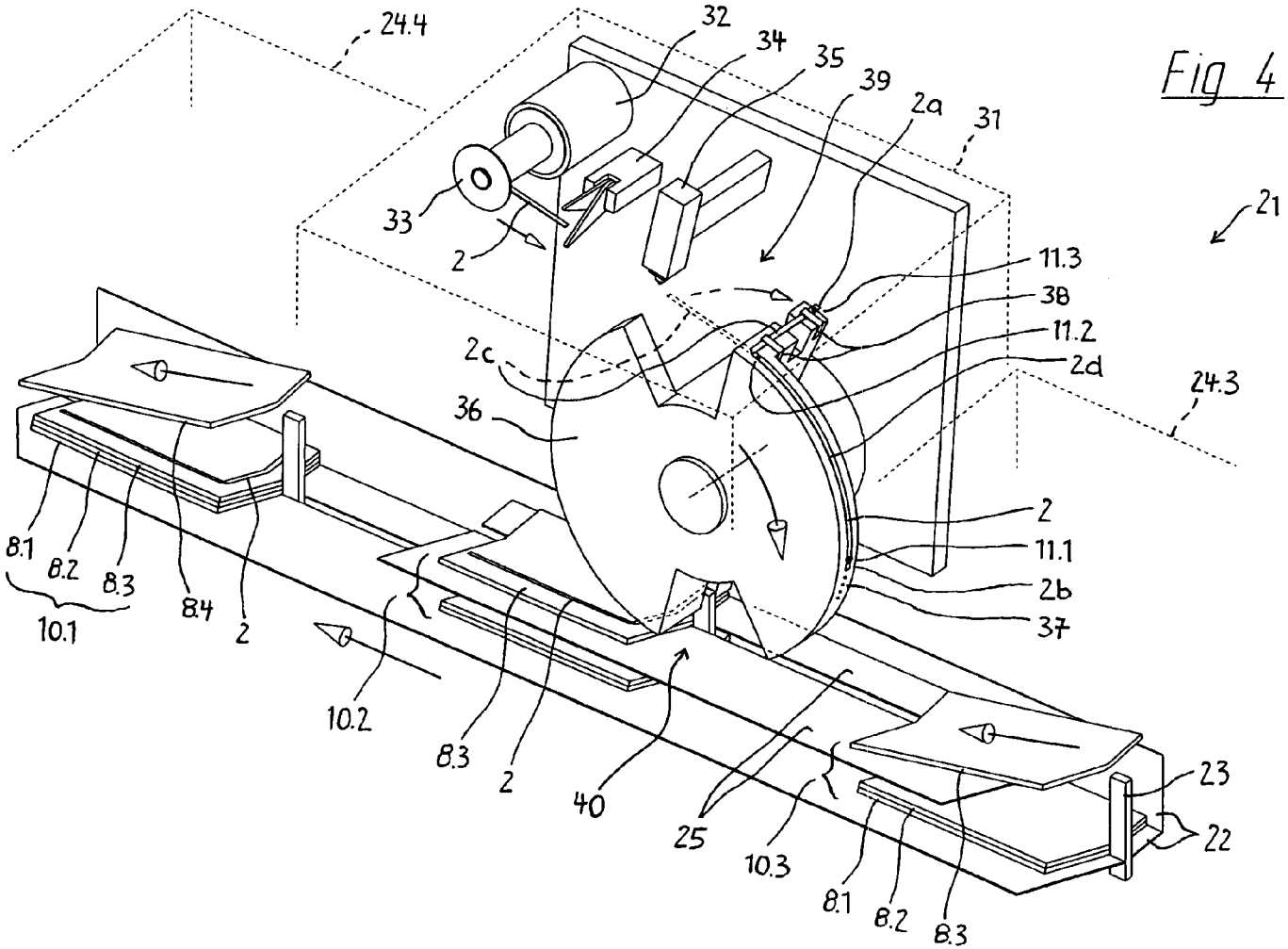
FIG. 4 shows a detail of a gathering machine 21 with a marking ribbon placement device 31.

FIGS. 3*a* to *f*, as well as FIG. 4, show the different processing steps for affixing the marking ribbon 2 on the example of the brochure 1. (Folded) sheets 8.1 . . . 3 initially are conventionally gathered into partial book blocks 10 or 10.1 . . . 3 in a gathering machine 21, wherein these partial book blocks are advanced in the conveying channel 22 of the gathering machine 21 by means of pushers 23.

During the advance movement in the conveying channel 22, a marking ribbon placement device 31 places a marking ribbon 2 in an L-shaped configuration on the top sheet 8.3 of the partial book block 10 or 10.2 that was deposited immediately prior thereto by a feed station 24.3, namely with a first limb 2*c* that extends along the head edge 9*a* of the sheet 8.3 and a second limb 2*d* that is oriented in the direction of the book block height.

In this case, the marking ribbon 2 is respectively fixed on the sheet 8.3 at the three gluing points 11.1 . . . 3 shown in FIG. 3*b* by means of one respective dot of preferably volatile hot-melt adhesive so as to secure the marking ribbon 2 against shifting or sliding at least until the book block is clamped in transport clamps of the downstream book binding machine. Alternatively, the marking ribbon 2 may also be fixed on the sheet 8.3 by means of electrostatics. The first end 2*a* approximately ends with the spine edge 9*b* of the top sheet 8.3 and may be permanently fixed on the sheet 8.3 at the gluing point 11.3 rather than with hot-melt adhesive.

Subsequently, additional (folded) sheets 8.4 . . . 6 are supplied. A feed station 24.4 for supplying the next (folded) sheet 8.4 is indicated in FIG. 4. The partial book block 10 or 10.1 . . . 3 is completed into a loose book block 12 such that the at least temporarily fixed marking ribbon 2 is now situated in the interior of the loose book block 12. The perfect binding process is then carried out. FIG. 3*d* shows the book block 13 that is processed on the spine, wherein the guttersticks of the (folded) sheets 8.1 . . . 6 are detached and the individual sheets are prepared for the subsequent glue application during the spine processing 14. The first end 2*a* of the marking ribbon 2 lies in the spine of the book block 13 with its edge.

The bound book block 15 is created with the glue application on the spine and, if applicable, on lateral surfaces near the spine (i.e., at the spine), wherein the first end 2*a* is also permanently glued into the book block spine with at least its terminal edge such that another permanent glue connection in the gluing point 11.3 can be eliminated. The book block 15 is additionally processed into the untrimmed brochure 16 by folding in the (soft) cover 4 in the perfect binding machine as shown in FIG. 3*e*. The untrimmed brochure 16 is subsequently placed onto a drying/cooling transport section and ultimately trimmed into the finished brochure 1 on the three non-bound sides 5*b* to *d* (see FIG. 3*f*).

Alternatively, the loosely gathered book block 12 with the marking ribbon 2 that lies in its interior and is at least temporarily fixed can be fed to a thread sewing machine or another binding process. It is furthermore possible to use the bound book block 15 for a (hardcover) book 6 such that the complicated affixing of the marking ribbon after the trimming on three sides can be eliminated on (hardcover) books.

The introduction of the marking ribbon takes place without the aid of a support element, e.g., in the form of a cardboard strip that would be perceived as disturbing on the finished product, namely the brochure or the book, and on which the marking ribbon would have to be previously wound up.

The L-shaped configuration of the marking ribbon 2 during its placement on the top sheet 8.3 makes it possible to realize a marking ribbon length that is longer than the page diagonal such that the marking ribbon 2 emerges from the foot/front cut corner when the brochure 1 is closed. According to the invention, however, it would also be possible to place the length of marking ribbon on the sheet 8.3 in a different loop shape.

The number of sheets 8.1 . . . 3 gathered prior to affixing the marking ribbon 2 should be chosen largely equal to the number of sheets 8.4 . . . 6 that are subsequently deposited in order to complete the book block 12. Consequently, the marking ribbon 2 is situated approximately in the center of the book block 3 and can be displaced to a front and a rear page of the book block 3 equally well. The marking ribbon placement device 31 realized in the form of an exchange station can be positioned accordingly along the gathering machine 21 for this purpose.

If two or more marking ribbon placement devices 31 are arranged on the gathering machine 21, working ribbons 2 can be affixed at several locations in order to additionally improve the reading comfort, e.g., for reference books and catalogs. In this case, the respectively next marking ribbon can already be placed on the sheet that was deposited on the preceding marking ribbon as the next sheet. Consequently, the maximum number of marking ribbons is equal to the number of gathered sheets 8.1 . . . 6 minus one.

The marking ribbon placement device 31 illustrated in FIG. 4 features an unwinding device 32, by means of which the marking ribbon 2 wound up on a marking ribbon roll 33 can be unwound. The marking ribbon placement device 31 furthermore features a cutting device 34 for cutting off the marking ribbon 2 in the desired length. The marking ribbon 2 is provided with a dot of adhesive at the corresponding gluing points 11.1 . . . 3 by means of a nozzle gluing device 35.

The marking ribbon 2 is received by a rotating circular transport means 36 at a receiving point 39 that lies above the conveying channel 22, wherein the second end 2*b* is initially carried along by holding means 37 in the form of suction elements at the circumference and the first end 2*a* or the first limb 2*c* is taken hold of by holding means 38 realized with clamping elements. In this case, the aforementioned first limb 2*c* was transferred from the previously linear configuration into the configuration that is angled by 90° from the circumference of the transporter.

The rotational movement of the transport means 36 moves the marking ribbon 2 to the delivery point 40. The marking ribbon 2 is placed on the partial book block 10.2 advanced by the pushers 23 with a rolling movement of the transport means 36 after it is released from the holding means 37, 38 and fixed on the top (folded) sheet 8.3 by being pressed against this sheet at least in the region of the gluing points 11.1 . . . 3. With respect to an accurately positioned and careful placement of the marking ribbon 2, it is advantageous to transport the (folded) sheet 8.3 on an intermediate plane 25 vertically spaced above the partially gathered sheets as shown in FIG. 4.

It should be appreciated that the invention can be incorporated into brochures, books, and similar printed materials with covers, which materials can be referred to collectively as "book products". Such book products include a book block formed by gathering several sheets such as folded sections and/or single sheets that are thread-sewn and/or perfect-bound in the spine.

The invention claimed is:

1. A method for affixing a marking ribbon to a book product having a book block formed by gathering several sheets, comprising:

forming a partial book block of at least one sheet including a top sheet while gathering said several sheets;

placing the marking ribbon on the top sheet;

depositing at least one other sheet on the partial book block and said top sheet during continued gathering of said several sheets to form a gathered book block having four unbound sides; and binding one side of the gathered book block including marking ribbon and trimming the other, non-bound sides of the gathered book block.

2. The method according to claim 1, wherein the marking ribbon is affixed on the top sheet in at least one point, before another sheet is deposited thereon.

3. The method according to claim 2, wherein the marking ribbon is electrostatically affixed on the top sheet.

4. The method according to claim 2 wherein the marking ribbon is affixed on the top sheet with a volatile hot-melt adhesive.

5. The method according to claim 2 wherein the marking ribbon has first and second ends, each sheet has a spine edge, a front edge opposite the spine edge, a head edge, and a foot edge, and the first end of the marking ribbon is permanently glued to the top sheet adjacent the head edge.

6. The method according to claim 5, wherein the marking ribbon is placed on the top sheet in such a way that the first end is at the spine edge of the top sheet.

7. The method according to claim 6, wherein the one side of the book to be bound defines the book block spine, and the first end of the marking ribbon is permanently affixed in the book block spine by applying glue thereon during subsequent binding of the book block.

8. The method according to claim 1, wherein the marking ribbon is placed on the top sheet in the shape of a loop.

9. The method according to claim 1, wherein each sheet has a spine edge, a front edge opposite the spine edge, a head edge, a foot edge and a height defined from the head edge to the foot edge, and the marking ribbon is placed on the top sheet in a substantially L-shaped configuration with a first limb that extends along the head edge of the top sheet and a second limb that is oriented in the direction of the height of the top sheet.

10. The method according to claim 1, wherein the marking ribbon has a length from the first to the second end, the trimmed book block has a page diagonal dimension, and the length of the marking ribbon placed on the top sheet is greater than the page diagonal of the trimmed book block.

11. The method according to claim 1 wherein the number of sheets in the partial book block prior to affixing the marking ribbon is approximately the same as the number of sheets subsequently deposited thereon in order to complete the gathering of the book block.

12. The method according to claim 1, wherein at least two marking ribbons are affixed, with each marking ribbon placed on a separate top sheet and at least one sheet deposited on each marking ribbon placed on a respective top sheet.

13. The method according to claim 1, wherein the marking ribbon is unwound from a supply roll and cut off.

14. The method according to claim 1, wherein the marking ribbon is supplied in a defined length and a defined three-dimensional configuration, to a transporter which deposits the ribbon marker on the top sheet at a predefined delivery location.

15. The method according to claim 1, wherein the marking ribbon is placed on the top sheet while the partial book block is advanced in a transport channel.

16. The method according to claim 15, wherein the marking ribbon is placed on the top sheet with a rolling movement of the transporter.

17. The method according to claim 16, wherein the top sheet is guided on an intermediate plane vertically above partially gathered sheets when the marking ribbon is placed thereon.

18. The method according to claim 1, wherein a cover is glued at the book block spine during the binding of the book block in order to produce a brochure.

19. The method according to claim 1, wherein after trimming, the bound book block is cased in a case.

20. A device for affixing a marking ribbon to a book product having a book block formed by gathering several sheets in a gathering machine, comprising:

an unwinding device that accommodates a supply roll of a wound-up marking ribbon;

several sheet feed stations that are arranged in a row upstream and downstream of said unwinding device, to deposit respective decollated sheets onto a conveying channel where partial book blocks are formed upstream of the unwinding device and gathered book blocks having four unbound sides are formed downstream of the unwinding device;

said conveying channel having pushers which advance a partial book block of at least one sheet including a top sheet to a location at the unwinding device where a marking ribbon is placed on the top sheet and advance the partial book block with marking ribbon from the unwinding device to be formed as a gathered book block, bound on one side, and trimmed on the other sides;

a cutting device at said location for cutting off a piece of marking ribbon from the supply roll in a defined length having first and second ends; and a transporter that takes hold of at least the first end and the second end of the marking ribbon with first and second holders and is displaceable between a receiving point and a delivery point, so as to place the marking ribbon at the delivery point on the top sheet of the partial book block that is advanced in the conveying channel.

21. The device according to claim 20, wherein the device is an exchange station of the gathering machine.

22. The device according to claim 20, including an applicator that applies glue on each piece of marking ribbon.

23. The device according to claim 20, wherein the transporter moves synchronously with the advancement of the partial book block at the delivery point, where the marking ribbon is released by the holders.

24. The device according to claim 20, wherein the transporter is driven in a rotating fashion.

25. The device according to claim 20, wherein one of the holders comprises a suction element that can be acted upon with suction air and blowing air and the other holder comprises a mechanical gripper that can be opened and closed.

26. The device according to claim 23, wherein the transporter is substantially circular and driven in rotating fashion;

the piece of ribbon marker is placed with an "L" shape in which a first limb of the "L" extends perpendicularly to the circle and a second limb of the "L" follows the circumference of the circle;

the first end of the ribbon marker is on the first limb and the second end of the ribbon marker is on the second limb;

and the first holder comprises a mechanical gripper that can be opened and closed and the second holder comprises suction elements at said circumference.

* * * * *